US007422131B2

(12) United States Patent
Cohen

(10) Patent No.: US 7,422,131 B2
(45) Date of Patent: Sep. 9, 2008

(54) THEFT DETERRENT BACKPACK

(76) Inventor: Cheryl F. Cohen, 304 Berkshire Ave., Cherry Hill, NJ (US) 08002

( * ) Notice: Subject to any disclaimer, the term of this patent is extended or adjusted under 35 U.S.C. 154(b) by 209 days.

(21) Appl. No.: 10/805,935

(22) Filed: Mar. 22, 2004

(65) Prior Publication Data

US 2005/0205635 A1 Sep. 22, 2005

(51) Int. Cl.
*A45F 3/04* (2006.01)
*B65D 33/16* (2006.01)
*B65D 33/00* (2006.01)

(52) U.S. Cl. ..... 224/654; 224/657; 224/651; 383/66; 383/97

(58) Field of Classification Search ..... 224/652, 224/657, 153, 585, 654, 645–651; 383/66, 383/97; 190/119–120, 101; 150/101–102
See application file for complete search history.

(56) References Cited

U.S. PATENT DOCUMENTS 2,838,085 A * 6/1958 Beeler ..... 190/115
3,019,952 A * 2/1962 Brewster ..... 294/142
3,316,951 A * 5/1967 Jacobson ..... 206/315.3
3,530,919 A * 9/1970 May ..... 206/315.4
4,563,777 A * 1/1986 Park ..... 2/108
5,154,332 A * 10/1992 Williams et al. ..... 224/153
5,377,887 A * 1/1995 Garcia ..... 224/153
5,458,278 A * 10/1995 LaConte ..... 224/651
5,887,770 A * 3/1999 Covell ..... 224/153
D415,344 S 10/1999 Leibowitz ..... D3/217
6,053,382 A 4/2000 Wyant ..... 224/153
6,109,495 A * 8/2000 Hernandez ..... 224/644
6,138,881 A * 10/2000 Paul et al. ..... 224/153
6,386,414 B1 * 5/2002 Kilduff ..... 224/638

FOREIGN PATENT DOCUMENTS

FR 2 852 797 A1 * 10/2004 ..... 224/654
WO WO 01/10261 A 2/2001

* cited by examiner

*Primary Examiner*—Jes F Pascua
(74) *Attorney, Agent, or Firm*—Cheryl F. Cohen, LLC

(57) ABSTRACT

A theft deterrent backpack including at least two panels forming a main compartment. The at least two panels include at least a back panel and a second panel, other than the back panel. The backpack also includes a releasable securing device for accessing the main compartment; the releasable securing device, for example, a zipper, having a beginning end and a terminating end. Preferably, the terminating end of the releasable securing device is disposed on the back panel and the beginning end is disposed on the second panel such as the front panel, side panel or bottom panel. When the backpack is worm, positioning of the releasable securing device in such a configuration deters access to the terminating end of the releasable securing device and hence access to the main compartment.

23 Claims, 4 Drawing Sheets

THEFT DETERRENT BACKPACK

BACKGROUND OF THE INVENTION

1. Field of the Invention

The present invention is directed to backpacks and, in particular, a backpack that substantially prohibits and deters theft of the contents stored therein.

2. Description of Related Art

Backpacks have been widely used as a means for advantageously freeing ones arms while carrying objects. Today, backpacks are used by students of all ages to carry their belongings to school. Backpacks are often used on vacations as well and are quite advantageous in that they free the user's hands allowing them to guide themselves using a map, hold a bottle of water, take a photograph or simply hold a child's hand. Historically, backpacks were used by outdoor enthusiasts (e.g., hikers) and casual dressed individuals (e.g., students or travelers). In the last several years backpacks have become quite stylish and have reached the designer markets. Today, backpacks are manufactured in leather and other fine quality materials sold by top designers to women for use as an alternative to a handbag. Backpacks have gained widespread acceptance, in particular, in large urban cities in which individuals are interested in following fashion trends.

A conventional backpack, for example, as disclosed in U.S. Pat. Nos. 6,053,382 and D415,344, comprises a front panel, a back panel and a side panel. The zipper that permits entry into the main compartment is disposed exclusively along the side panel. To provide more organization dividers or pockets may be sewn into the interior of the main compartment. In addition, exterior pockets may be disposed along the back panel, side panel and/or front panel. Each pocket generally has its own releasable securing device, e.g., a zipper, for entry into the associated subcompartment.

This conventional zipper configuration is disadvantageous in that when worn, as intended on one's back, the zipper opening disposed on the side panel permits access by thieves to the contents stored in the main compartment while out of the wearer's visual sight. Depending on the contents stored inside the main compartment of the backpack this poses various concerns. When on a trip, the traveler often stores their wallet, passport, airline tickets, camera and/or video camcorder in their backpack. Likewise, designer backpacks are typically used by women in lieu of a pocketbook in which they store their wallet in the main compartment. Often you will see a tourist with the backpack purposefully worn against their chest rather than their back so that the wearer can visually watch to prohibit stealing of their valuables. The backpack, however, is bulky and, if heavy, can cause hunching forward creating inappropriate posture and potential back pain when worn on one's chest instead of back.

One conventional alternative to combat thievery is to resort to using a separate locking device similar to that used for a piece of luggage. Conventional backpacks typically have a zipper disposed about the side panel, e.g., where the front panel and side panel are assembled together, and two pull tabs are employed to access the main compartment via the zipper. Entry into the backpack may be prohibited by securing the pull tabs together and passing a lock through an aperture defined in each pull tab. This is disadvantageous for several reasons. The backpack is generally not sold with the locking device and thus the consumer must acquire this separate component on their own. Even if the lock and backpack were sold together the extra expense of the lock would increase the overall cost of the backpack. In addition, locks are commonly manufactured from a metal that adds extra weight to the backpack. If the lock is a combination lock, then the user must remember the combination in order to access the contents of the backpack. Alternatively a keyed entry lock is disadvantageous in that the key must be stored in a location other than in the backpack thereby defeating the underlying purpose of the backpack, i.e., to store all your valuables. The key itself may also be lost, stolen or misplaced.

Another conventional means for tamper proofing the main compartment in lieu of using locks is to provide access to the main compartment exclusively via a zipper whose terminating ends are both disposed along the back panel, hereinafter referred to as a two-dimensional zipper, i.e., a zipper disposed exclusively along a single panel. Because the zipper is disposed along only a single panel, i.e., the back panel, the size of the opening and thus access to the contents of the main compartment is severely restricted by the length of the zipper chain. It is therefore difficult to view the objects in the main compartment in order located a particular object without feeling around. Furthermore, the size of an object to be placed in the main compartment is limited by what fits through the zipper disposed only along the back panel despite the fact that the main compartment is typically sized to accommodate a significantly larger object.

Accordingly, it is desirable to develop a theft deterrent backpack without employing a separate locking device that readily permits removal of an object from the main compartment of a size limited only by the dimension or capacity of the main compartment itself.

SUMMARY OF THE INVENTION

The present invention is directed to a theft deterrent backpack that substantially prohibits stealing of the contents in its main compartment while being worn by a user.

A theft deterrent backpack including at least two panels forming a main compartment. The at least two panels include a back panel and a second panel, other than the back panel. The backpack also includes a releasable securing device for accessing the main compartment; the releasable securing device, for example, a zipper, having a beginning end and a terminating end. Preferably, the terminating end of the releasable securing device is disposed on the back panel and the beginning end is disposed on the second panel such as the front panel, side panel or bottom panel. When the backpack is worn, positioning of the releasable securing device in such a configuration deters access to the terminating end of the releasable securing device and hence access to the main compartment. Since the releasable securing device extends three-dimensionally along at least two panels such as the front and back panels, it provides a relatively large opening or mouth through which the main compartment may be filled limited only by the dimension or capacity of the main compartment itself.

In addition, the present invention relates to a theft deterrent backpack including at least two panels forming a main compartment. One panel is a back panel while a second panel is a panel other than the back panel. The backpack further includes a zipper chain for accessing the main compartment, wherein the zipper chain has a beginning end and a terminating end. Preferably, the zipper chain is disposed so that the terminating end is disposed on the back panel and the beginning end is disposed on the second panel.

Still another embodiment of the backpack in accordance with the present invention includes a main compartment formed by a plurality of panels, the plural panels including at least a front panel and a back panel. The backpack also includes a releasable securing device for accessing the main compartment, wherein the releasable securing device extends along two or more of the plural panels.

BRIEF DESCRIPTION OF THE DRAWINGS

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE PREFERRED EMBODIMENTS

Figure 1:
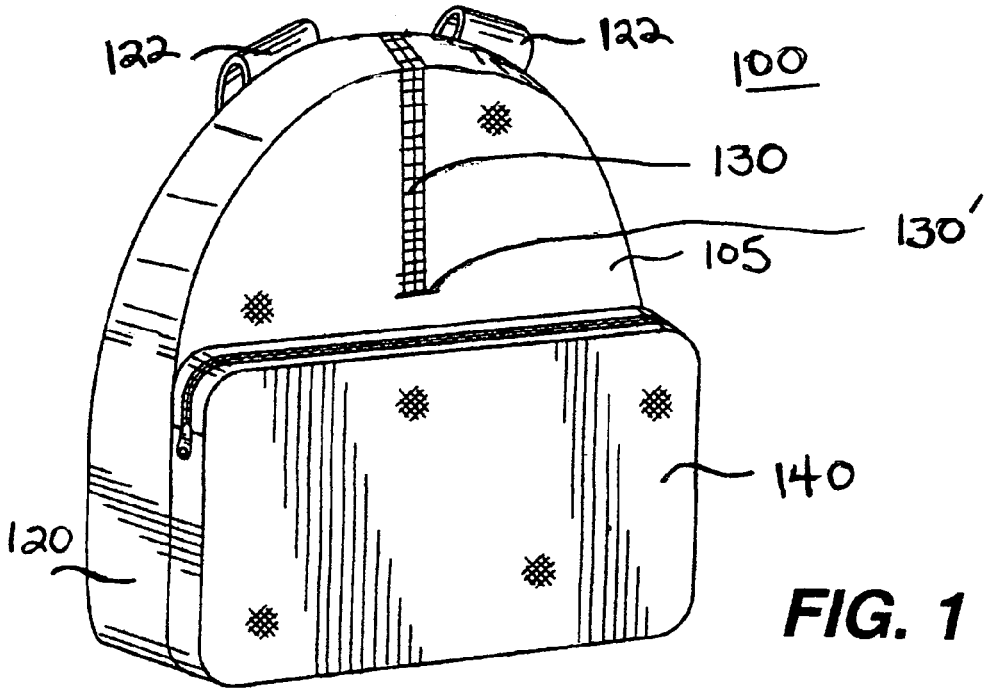
FIG. 1 is an exemplary front perspective view of a backpack in accordance with the present invention having a three-dimensional zippered opening for entry into the interior of the main compartment, wherein the zipper is disposed so as to extend along a plurality of panels.
Figure 2:
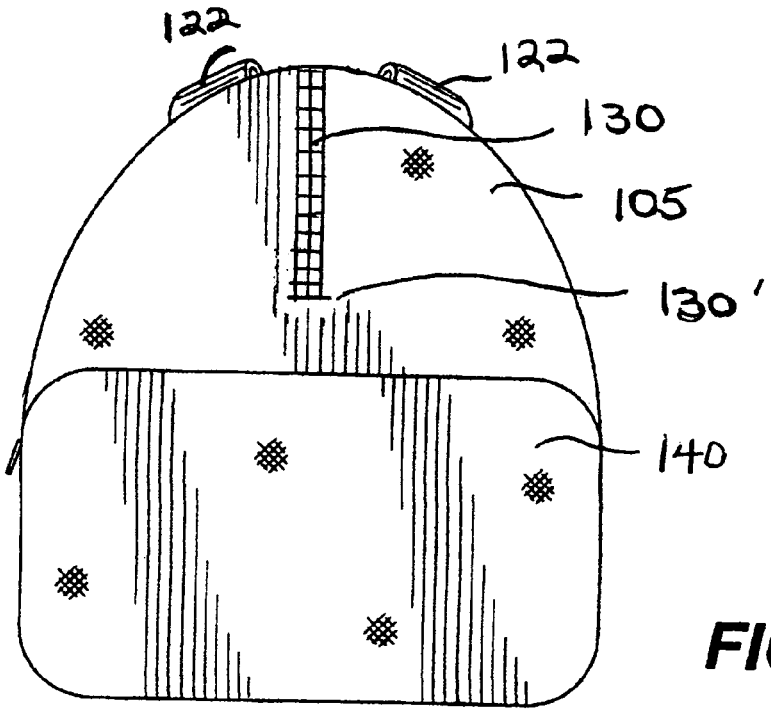
FIG. 2 is a front view of the backpack of FIG. 1.
Figure 3:
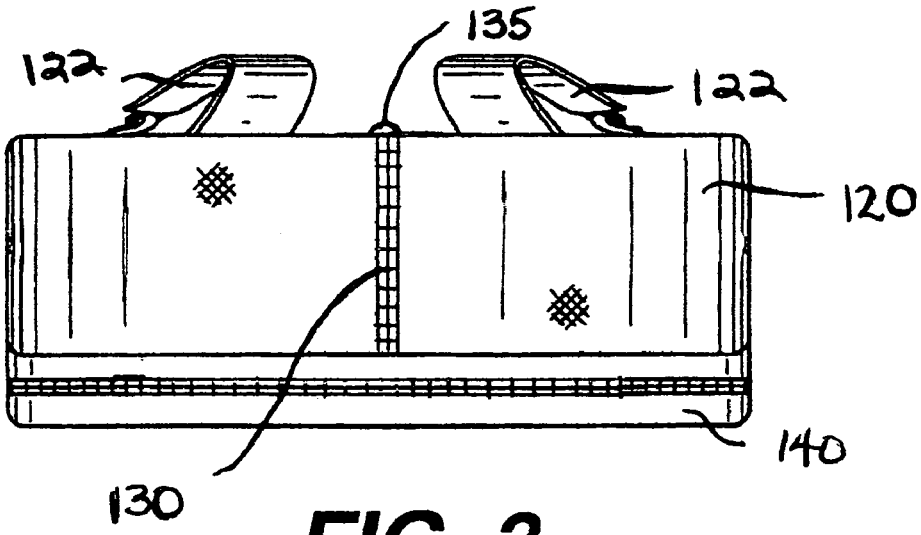
FIG. 3 is a top view of the backpack of FIG. 1.
Figure 4:
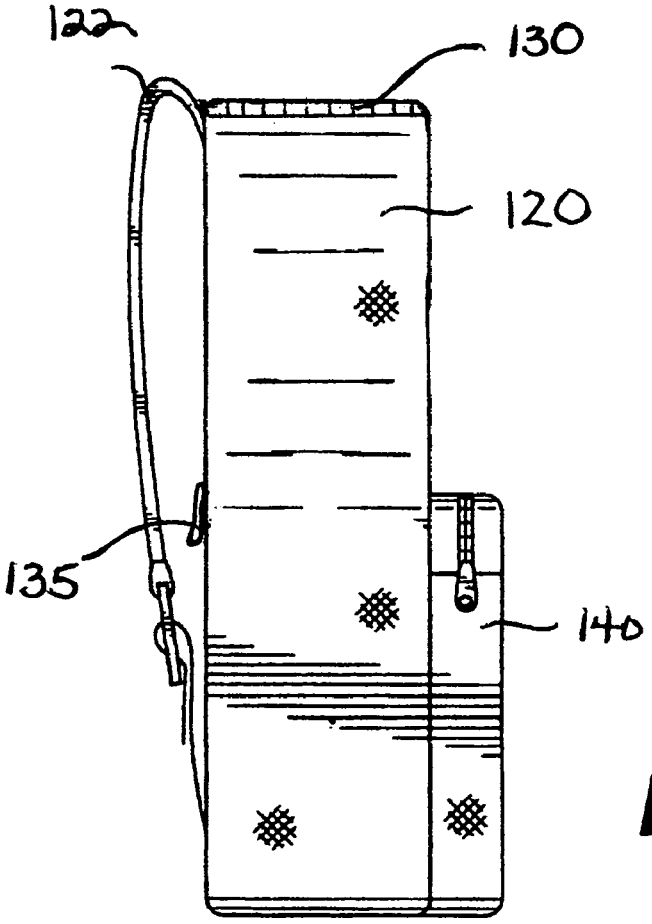
FIG. 4 is a left side view of the backpack of FIG. 1.
Figure 5:
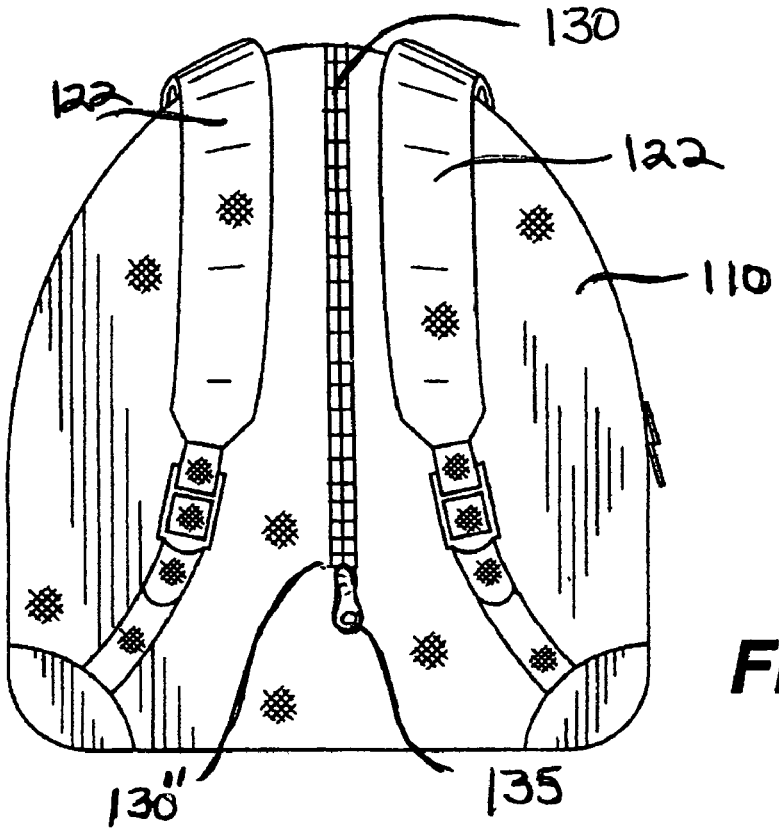
FIG. 5 is a back view of the backpack of FIG. 1.
Figure 6:
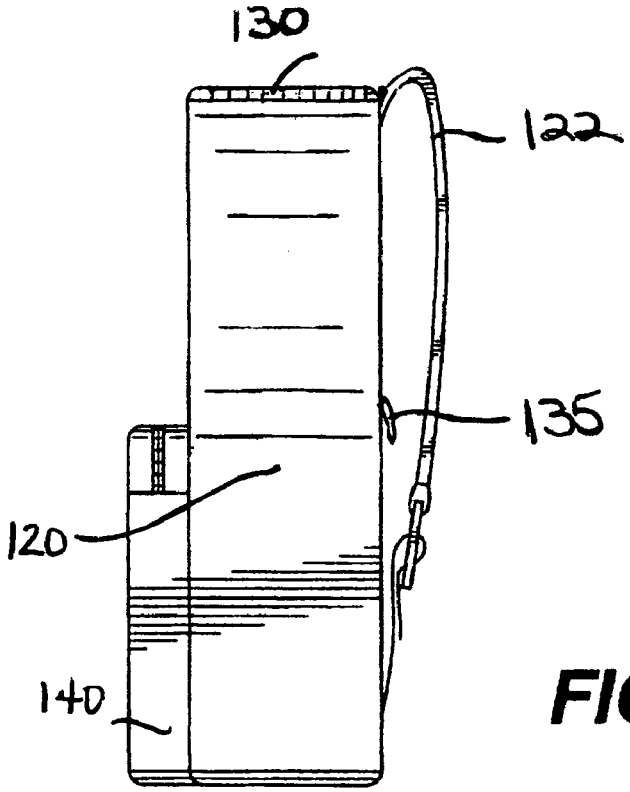
FIG. 6 is a right side view of the backpack of FIG. 1.
Figure 7:
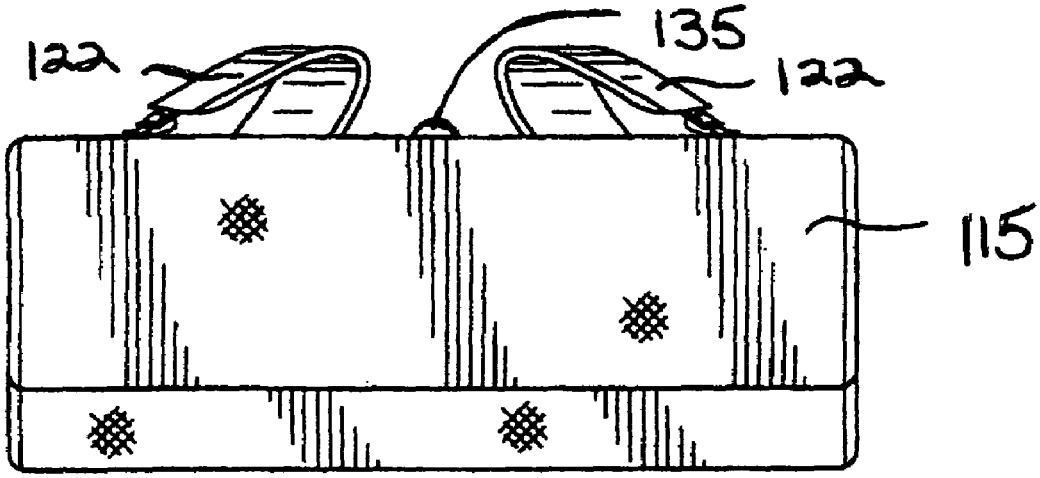
FIG. 7 is a bottom view of the backpack of FIG. 1.

An exemplary theft deterrent backpack 100 in accordance with the present invention is shown in FIGS. 1-7. As shown in the front perspective view in FIG. 1, the backpack 100 includes a main compartment formed by a front panel 105, a back panel 110 (FIG. 5), a bottom panel 115 (FIG. 7), and a side panel 120. In addition, the backpack 100 is shown, by way of example, with an exterior pocket 140 disposed on the front panel 105. The present invention can be designed to include any number of exterior pockets, or none whatsoever. The term "back panel" is defined as that panel which at least some portion of rests against the wearer's body when worn as intended. Two shoulder straps 122 are shown, however, any number of one or more straps may be used as desired. The backpack shown in FIG. 1 is for illustrative purposes only and is not intended to limit the scope of the invention. Specifically, the backpack 100 need not have a bottom and/or a side panel whereby the back and front panels, 110, 105, respectively, are affixed directly to one another. In addition, each of the front, back, bottom and side panels need not be an integral piece or unit but instead may be comprised of multiple pieces or units attached (e.g., sewn) together. It is also contemplated and within the scope of the invention that the backpack may be configured in any desired shape and from any desired material.

When assembled, e.g., sewn together, the front panel 105, back panel 110, bottom panel 115 and side panel 120 form or define a main compartment therein. The main compartment may comprise a single cavernous unit or its interior may be subdivided into multiple subcompartments using dividers and/or interior pockets to provide more organization and prevent shifting of the objects stored therein.

Access to the main compartment is provided by a three-dimensional releasable securing device 130, i.e., a releasable securing device disposed along at least two panels. By way of illustrative example, the present invention will be shown and described with a zipper as the releasable securing device. Any type of releasable securing device is permitted and within the intended scope of the invention, preferably one forming a continuous strip having only one terminating end from which disengagement of the mating components of the strip starts and only one beginning end, opposite the terminating end, from which engagement of the mating components of the strip starts. In the configuration employing a zipper chain, as shown in the figures, individual teeth elements of each half when meshed together form a continuous piece referred to as a chain. Each zipper chain has a beginning end 130' (representing that end of the zipper chain at which the slider and pull tab mounted thereto (together referred to as reference element 135) originates prior to meshing the teeth together) and an opposite terminating end 130" (representing that end of the zipper chain at which the slider 135 terminates when the teeth are meshed together as a continuous chain). In the present invention configuration, when the backpack is held substantially upright, the zipper chain 130 is disposed substantially longitudinally from the front panel 105, across the side panel 120 and down the back panel 110. Specifically, the terminating end of the zipper chain is disposed on the back panel 110, while the opposite beginning end of the zipper chain is disposed on the front panel 105. Preferably, the terminating end of the zipper chain is adapted to extend sufficiently down the back panel so that it rests against the wearer's back when the backpack is worn. Most preferably, the terminating end of the zipper chain extends at least halfway down the back panel. Otherwise, if the terminating end of the zipper chain is disposed proximate the intersection of the back panel and side panel then unwanted access to the zipper may be gained and its deterrent effect may be diminished. This is particularly the case in which the top of the backpack does not lay flush against the wearer's body whereby a thief could potentially still gain access to the pull tab of the zipper if its terminating end is not disposed sufficiently down the back panel.

As previously mentioned, the side panel 120 of the backpack may be eliminated, wherein the zipper chain 130 is disposed substantially longitudinally from the front panel 105 and down the back panel 110 with the positioning of the terminating and beginning ends being the same as that disclosed above when a side panel is employed.

While wearing the backpack with the zipper chain 130 engaged or zipped, the placement of the terminating end of the zipper chain disposed on the back panel 110 is such that access to the slider and pull tab mounted thereto is substantially prohibited by the backpack resting against the wearer's body. Despite being able to view the beginning end of the zipper chain disposed on the front panel of the backpack, a thief can not access the zipper starting from this end. Filling and emptying of the main compartment of the backpack is improved in that zipper chain is three-dimensional, i.e., the zipper chain extends over at least two panels, e.g., the front panel and back panel, providing a larger opening to insert the objects to be stored therein.

In the embodiment shown in FIG. 1-7 the zipper chain is disposed substantially longitudinally on the backpack. Alternatively, the zipper chain 130 can be disposed substantially laterally along the front panel 105, across the side panel 120 and onto the back panel 110. Any positioning or placement of the zipper chain is contemplated and within the intended scope of the present invention as long as the releasable securing device extends over at least two panels and/or the terminating end of the zipper chain is disposed on the back panel and the beginning end is disposed on another panel (e.g., front panel, side panel or bottom panel) other than the back panel. It should be pointed out that the zipper chain can extend over more than two panels. For example, as shown in FIGS. 1-7 the zipper chain extends from its terminating end to its beginning end over three panels, namely, the back panel, side panel and front panel respectively.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

Every issued patent, pending patent application, publication, journal article, book or any other reference cited herein is each incorporated by reference in their entirety.

What is claimed is:

1. A theft deterrent backpack comprising:

a plurality of panels attached to one another forming a main compartment of the backpack, the plural panels including a back panel with two shoulder straps each attached at both ends to the back panel and the plural panels further including a second panel, other than the back panel; and a single substantially linear releasable securing device for accessing the main compartment of the backpack, the releasable securing device having a beginning end and a terminating end, the terminating end being disposed on the back panel and the beginning end being disposed on the second panel.

2. The theft deterrent backpack according to claim 1, wherein the second panel is a front panel.

3. The theft deterrent backpack according to claim 2, wherein the backpack further includes a side panel and the releasable securing device extends across at least a portion of the side panel.

4. The theft deterrent backpack according to claim 2, wherein the backpack further includes a bottom panel and the releasable securing device extends across at least a portion of the bottom panel.

5. The theft deterrent backpack according to claim 1, wherein the second panel is a side panel.

6. The theft deterrent backpack according to claim 1, wherein the second panel is a bottom panel.

7. The theft deterrent backpack according to claim 1, wherein the releasable securing device is a zipper chain.

8. The theft deterrent backpack according to claim 1, wherein the releasable securing device is disposed substantially longitudinally, when the backpack is held substantially upright.

9. The theft deterrent backpack according to claim 1, wherein the releasable securing device is disposed substantially laterally, when the backpack is held substantially upright.

10. The theft deterrent backpack according to claim 1, wherein the releasable securing device extends at least substantially halfway along the back panel of the backpack when the backpack is held substantially upright.

11. The theft deterrent backpack according to claim 1, wherein the releasable securing device is adapted to extend sufficiently along the back panel of the backpack so that the terminating end rests against a wearer's body when worn.

12. The theft deterrent backpack according to claim 1, wherein the plural panels are integral with one another.

13. A theft deterrent backpack comprising:

a plurality of panels attached to one another forming a main compartment of the backpack, the plural panels including a back panel with two shoulder straps each attached at both ends to the back panel and the plural panels further including a second panel, other than the back panel; and a single substantially linen zipper chain for accessing the main compartment of the backpack, the zipper chain having a beginning end and a terminating end, the zipper chain being disposed so that the terminating end is disposed on the back panel and the beginning end is disposed on the second panel.

14. The theft deterrent backpack in accordance with claim 13, wherein the second panel is a front panel.

15. The theft deterrent backpack according to claim 14, wherein the backpack further includes a side panel and the zipper chain extends across at least a portion of the side panel.

16. The theft deterrent backpack according to claim 14, wherein the backpack further includes a bottom panel and the zipper chain extends across at least a portion of the bottom panel.

17. The theft deterrent backpack in accordance with claim 13, wherein the second panel is a side panel.

18. The theft deterrent backpack in accordance with claim 13, wherein the second panel is a bottom panel.

19. The theft deterrent backpack according to claim 13, wherein the zipper chain is disposed substantially longitudinally, when the backpack is held substantially upright.

20. The theft deterrent backpack according to claim 13, wherein the zipper chain is disposed substantially laterally, when the backpack is held substantially upright.

21. The theft deterrent backpack according to claim 13, wherein the zipper chain extends at least substantially halfway along the back panel of the backpack when the backpack is held substantially upright.

22. The theft deterrent backpack according to claim 13, wherein the zipper chain is adapted to extend sufficiently down the back panel of the backpack so that the terminating end rests against a wearer's body when worn.

23. The theft deterrent backpack according to claim 13, wherein the plural panels arc integral with one another.

* * * * *